United States Patent [19]

Araki

[11] Patent Number: 4,648,998

[45] Date of Patent: Mar. 10, 1987

[54] CHARGE FORMING APPARATUS

[75] Inventor: Satoru Araki, Zama, Japan

[73] Assignee: Shingawa Daikasuto Kogyo Kabushiki Kaisha, Japan

[21] Appl. No.: 710,221

[22] Filed: Mar. 11, 1985

[51] Int. Cl.[4] ..... F02M 7/08

[52] U.S. Cl. ..... 261/34.2; 92/158; 92/79; 251/80; 417/313; 417/444

[58] Field of Search ..... 261/DIG. 68, 34 A; 92/158; 251/80, DIG. 1; 92/79; 417/313, 444

[56] References Cited

U.S. PATENT DOCUMENTS

| | | | |
|---|---|---|---|
| 837,680 | 12/1906 | Goehns | 92/158 |
| 2,267,897 | 12/1941 | Carrico | 417/313 |
| 2,296,132 | 9/1942 | Wiseley | 251/80 |
| 2,306,813 | 12/1942 | King | 92/79 |
| 2,649,290 | 8/1953 | Griffon | 261/34 A |
| 2,705,123 | 3/1955 | Hieger | 251/900 |
| 3,003,754 | 10/1961 | Phillips | 261/DIG. 68 |
| 3,017,167 | 1/1962 | Griffon | 261/34 A |
| 3,281,128 | 10/1966 | Phillips | 261/DIG. 68 |
| 3,301,240 | 1/1967 | Peresada | 92/158 |
| 3,404,872 | 10/1968 | Nutten | 261/DIG. 68 |
| 3,453,994 | 7/1969 | Nutten et al. | 261/DIG. 68 |
| 3,810,716 | 5/1974 | Abrahams et al. | 417/313 |
| 4,046,844 | 9/1977 | Rickert | 261/34 A |

FOREIGN PATENT DOCUMENTS

| | | | |
|---|---|---|---|
| 464506 | 4/1950 | Canada | 251/DIG. 1 |
| 45-20844 | 7/1970 | Japan | 261/34 A |

*Primary Examiner*—Tim Miles

*Attorney, Agent, or Firm*—Steinberg & Raskin

[57] ABSTRACT

A charge forming apparatus or carburetor having a mixture passage and a throttle valve arranged therewithin. A fuel pressure control mechanism comprises a chamber from which controlled fuel is fed to the mixture passage. A flexible diaphragm defines one of the walls of the fuel chamber. A cam is formed at a throttle shaft which supports the throttle valve. An acceleration pump comprises a cylindrical chamber, a piston received in the cylindrical chamber, and a spring for contacting the piston with the cam on the throttle shaft.

7 Claims, 12 Drawing Figures

CHARGE FORMING APPARATUS

BACKGROUND OF THE INVENTION

1. Field of the Invention

This invention generally relates to a charge forming apparatus for supplying a mixture of fuel and air to an internal combustion engine, and more particularly to a charge forming apparatus or carburetor which is adapted to control fuel to be fed to a mixture passage by means of a flexible diaphragm according to the demand of an internal combustion engine.

2. Description of the Prior Art

A carburetor of the type of controlling fuel by means of a float or float-type carburetor has been conventionally used, for example, in an engine for an automobile and is required not to substantially tilt and fall down.

A carburetor of the type of controlling fuel by means of a diaphragm or diaphragm-type carburetor has been typically used in a two-cycle engine for a chain saw, a mowing machine, a snowmobile, a boat or the like and has an advantage capable of controlling fuel in any posture.

The conventional diaphragm-type carburetor generally comprises a body formed therein with a passage for a mixture of air and fuel in which a venturi and a throttle valve are arranged, a fuel pump having a diaphragm adapted to be actuated by an engine pulse, a passage arranged to outward extend from the outlet of the fuel pump, a fuel chamber having one of the walls thereof defined by a flexible diaphragm, a valve controlled by the flexible diaphragm so as to open or close the inlet of the passage communicated with the fuel chamber, and a supply passage for feeding fuel in the fuel chamber to a slow port and an idle port opened toward a main nozzle and a throttle valve each communicated with a venturi of the mixture passage. In the diaphragm-type carburetor constructed as described above, the fuel pump and a fuel pressure control mechanism are arranged on the surface of the body, and the diaphragms and a cover member are fixed on the body.

In view of the foregoing, it will be noted that the diaphragm-type carburetor is characterized in its small-sized and compact structure. Also, in the diaphragm-type carburetor, the idle port and slow port serve to feed fuel to the mixture passage due to high negative pressure generated not on the side of the substantially closed throttle valve but on the side of an engine at the idling or slow rotational speed of the engine and the main nozzle acts to feed fuel to the mixture passage due to high negative pressure generated at the venturi at a medium or high engine speed. Such a fuel supply system is substantially the same as that in the float-type carburetor.

In the diaphragm-type carburetor, only the construction which is capable of carrying out the supply of a mixture of air and fuel to an engine in a manner to prevent the occurrence of trouble in a two-cycle engine of small displacement such as engine malfunction has been required. Thus, the diaphragm-type carburetor fails to rapidly increase fuel corresponding to a rapid increase in air flowing through the mixture passage when the substantially closed throttle valve is rapidly opened, so that such an increase in engine speed as expected by a driver may not be obtained in the diaphragm-type carburetor.

SUMMARY OF THE INVENTION

The present invention has been made in view of the foregoing disadvantages of the prior art.

Accordingly, it is a primary object of the present invention to provide a charge forming apparatus or a diaphragm-type carburetor provided with an acceleration mechanism which is capable of rapidly increasing fuel corresponding to a rapid increase in air.

It is another object of the present invention to provide a charge forming apparatus or a diaphragm-type carburetor which is compactly and simply constructed and provided with an acceleration mechanism comprising a cylindrical chamber formed in the body, a piston received in the cylindrical chamber and a cam formed at a throttle shaft for reciprocating the piston.

It is another object of the present invention to provide a charge forming apparatus or a diaphragm-type carburetor which is constructed in a manner such that a cylindrical chamber of an acceleration pump is connected to a supply pipe for feeding fuel from a fuel chamber of a fuel pressure control mechanism to a main nozzle to simplify the structure of a passage for supplemental fuel or supplemental fuel passage.

It is an additional object of the present invention to provide a charge forming apparatus or a diaphragm-type carburetor which is constructed in a manner such that a cylindrical chamber of an acceleration pump is connected to a supply passage of a fuel pressure control mechanism for feeding fuel from a fuel chamber to an idle port and a slow port or the cylindrical chamber is provided on the way along the supply pipe, so that the structure of a supplemental fuel passage may be significantly simplified and supplemental fuel may be fed to a mixture passage at the portion thereof near an engine to increase the rotational speed of the engine with good responsibility.

It is a further object of the present invention to provide a charge forming apparatus or diaphragm-type carburetor which is capable of eliminating resistance unnecessary for the actuation of a throttle valve by linearly smoothly reciprocating a piston of an acceleration pump in a cylindrical chamber.

It is still a further object of the present invention to provide a charge forming apparatus or diaphragm-type carburetor which is capable of effectively eliminating a defect that air collected in a cylindrical chamber is directly discharged to a supply passage to prevent the normal supply of fuel.

It is an even further object of the present invention to provide a charge forming apparatus or diaphragm-type carburetor which is capable of eliminating a defect that air enters a cylindrical chamber through a small gap formed around a throttle shaft and a piston when a throttle valve is substantially fully opened and then is sucked by a main nozzle, to thereby prevent the normal supply of fuel.

In accordance with the present invention, there is provided a charge forming apparatus comprising a body which is formed therein with a mixture passage having a throttle valve arranged therein; a fuel pressure control mechanism arranged on the body, the fuel pressure control mechanism comprising a fuel chamber from which controlled fuel is fed to the mixture passage and a flexible diaphragm defining one of the walls of the fuel chamber; a cam means formed at a throttle shaft supporting the throttle valve thereon; and an acceleration pump comprising a cylindrical chamber formed in the body, a piston received in the cylindrical chamber and a spring means for contacting the piston with the cam means.

In accordance with the present invention, there is also provided a charge forming apparatus comprising a body which is formed therein with a mixture passage having a throttle valve arranged therein; a first supply passage through which fuel is fed to a main nozzle communicated with the mixture passage; a second supply passage through which fuel is fed to a slow port and an idle port; a fuel pressure control mechanism arranged on the body, the fuel pressure control mechanism comprising a fuel chamber from which controlled fuel is fed to the first and second supply passages and a flexible diaphragm defining one of the walls of the fuel chamber; a cam means formed at a throttle shaft supporting the throttle valve thereon; an acceleration pump comprising a cylindrical chamber formed in the body, a piston received in the cylindrical chamber and a spring means for contacting the piston with the cam means; and a passage for supplemental fuel through which the first supply passage and the cylindrical chamber are connected with each other.

Also, in accordance with the present invention, there is provided a charge forming apparatus comprising a body which is formed therein with a mixture passage having a throttle valve arranged therein; a first supply passage through which fuel is fed to a main nozzle communicated with the mixture passage; a second supply passage through which fuel is fed to a slow port and an idle port; a fuel pressure control mechanism arranged on the body, the fuel pressure control mechanism comprising a fuel chamber from which controlled fuel is fed to the first and second supply passages and a flexible diaphragm defining one of the walls of the fuel chamber; a cam means formed at a throttle shaft supporting the throttle valve thereon; an acceleration mechanism comprising a cylindrical chamber formed in the body, a piston received in the cylindrical chamber and having a valve means, and a spring means for contacting the piston with the cam means; and a passage for supplemental fuel through which the first supply passage and the cylindrical chamber are connected with each other, said passage being adapted to be closed by the valve means when the throttle valve is fully opened.

In addition, in accordance with the present invention, there is provided a charge forming apparatus comprising a body which is formed therein with a mixture passage having a throttle valve arranged therein; a fuel pressure control mechanism arranged on the body, the fuel pressure control mechanism comprising a fuel chamber from which controlled fuel is fed to the mixture passage and a flexible diaphragm defining one of the walls of the fuel chamber; a cam means formed at a throttle shaft supporting the throttle valve thereon; an acceleration mechanism having an acceleration pump which comprises a cylindrical chamber formed in the body, a piston received in the cylindrical chamber and formed at the intermediate portion thereof with an annular recess, and a spring means for contacting the piston with the cam means; and a fuel passage for lubrication and airtightness which extends from the fuel chamber and is communicated with the cylindrical chamber at the portion of the side wall of the cylindrical chamber facing the side surface of the piston.

Further, in accordance with the present invention, there is provided a charge forming apparatus comprising a body which is formed therein with a mixture passage having a throttle valve arranged therein; a fuel pressure control mechanism arranged on the body, the fuel pressure control mechanism comprising a fuel chamber from which controlled fuel is fed to the mixture passage and a flexible diaphragm defining one of the walls of the fuel chamber; a cam means formed at a throttle shaft supporting the throttle valve thereon; an acceleration mechanism comprising an acceleration pump and a passage for supplemental fuel, the acceleration pump comprising a cylindrical chamber formed in the body, a piston received in the cylindrical chamber and a spring means for contacting the piston with the cam means, the passage for supplemental fuel being communicated with the cylindrical chamber; and a screen arranged to cover the opened connection of the passage with the cylindrical chamber.

Additionally, in accordance with the present invention, there is provided a charge forming apparatus comprising a body which is formed therein with a mixture passage having a throttle valve arranged therein; a first supply passage through which fuel is fed to a main nozzle communicated with the mixture passage; a second supply passage through which fuel is fed to a slow port and an idle port; a fuel pressure control mechanism arranged on the body, the pressure control mechanism comprising a fuel chamber from which controlled fuel is fed to the first and second supply passages and a flexible diaphragm defining one of the walls of the fuel chamber; a cam means formed at a throttle shaft supporting the throttle valve thereon; and an acceleration pump comprising a cylindrical chamber formed in the body, a piston received in the cylindrical chamber and a spring means for contacting the piston with the cam means, the cylindrical chamber constituting a part of the second supply passage.

Furthermore, in accordance with the present invention, there is provided a charge forming apparatus comprising a body which is formed therein with a mixture passage having a throttle valve arranged therein; a fuel pressure control mechanism arranged on the body, the fuel pressure control mechanism comprising a fuel chamber from which controlled fuel is fed to the mixture passage and a flexible diaphragm defining one of the walls of the fuel chamber; a cam means formed at a throttle shaft supporting the throttle valve thereon; an acceleration pump comprising a cylindrical chamber formed in the body, a piston received in the cylindrical chamber and a spring means for contacting the piston with the cam means; and a fuel supply passage of which a part is formed by the cylindrical chamber, the fuel supply passage having a check valve arranged at the portion thereof between the fuel chamber and the cylindrical chamber so as to be closed toward the fuel chamber and a needle valve arranged at the portion thereof between the cylindrical chamber and slow and idle ports communicated with the mixture passage so as to control fuel.

Still further, in accordance with the present invention, there is provided a charge forming apparatus comprising a body which is formed therein with a mixture passage having a throttle valve arranged therein; a first passage through which fuel is fed to a main nozzle communicated with the mixture passage; a second passage through which fuel is fed to a slow port and an idle port; a fuel pressure control mechanism arranged on the body, the fuel pressure control mechanism comprising a fuel chamber from which controlled fuel is fed to the first and second supply passages and a flexible diaphragm defining one of the walls of the fuel chamber; a cam means formed at a throttle shaft supporting the throttle valve thereon; an acceleration pump comprising a cylindrical chamber formed in the body, a piston received in the cylindrical chamber and a spring means for contacting the piston with the cam means; and a passage for supplemental fuel through which the second passage and the cylindrical chamber are connected with each other.

Even further, in accordance with the present invention, there is provided a charge forming apparatus comprising a body which is formed therein with a mixture passage having a throttle valve arranged therein; a fuel pressure control mechanism arranged on the body, the fuel pressure control mechanism comprising a fuel chamber from which controlled fuel is fed to the mixture passage and a flexible diaphragm defining one of the walls of the fuel chamber; a cam means formed at a throttle shaft supporting the throttle valve thereon; an acceleration pump comprising a cylindrical chamber formed in the body, a piston received in the cylindrical chamber and a spring means for contacting the piston with the cam means; a supply passage through which fuel is fed to a slow port and an idle port each communicated with the mixture passage, the supply passage being communicated with the fuel chamber and having a needle valve for controlling fuel and a check valve closed toward the fuel chamber arranged therein; and a passage for supplemental fuel communicated at the portion thereof between the needle valve and the check valve in the supply passage with the cylindrical chamber.

BRIEF DESCRIPTION OF THE DRAWINGS

Other objects and many of the attendant advantages of the present invention will be readily appreciated as the same becomes better understood by reference to the following description when considered in connection with the accompanying drawings, in which.

DETAILED DESCRIPTION OF THE PREFERRED EMBODIMENT

Figure 1:
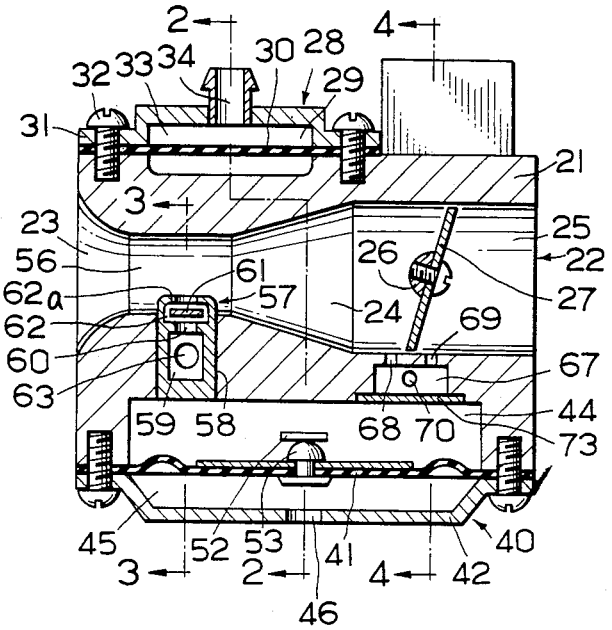
FIG. 1 is a vertical sectional view illustrating one embodiment of a charge forming apparatus or carburetor according to the present invention which is taken along the central line of a mixture passage.

Now, a charge forming apparatus or carburetor according to the present invention will be described with reference to the accompanying drawings.

An embodiment of a carburetor of the diaphragm type according to the present invention and an acceleration mechanism therefor are shown in FIGS. 1 to 7.

A carburetor shown in FIGS. 1 to 7 includes a carburetor body which has an air inlet passage 23, a venturi 24 and a mixture outlet region 25 formed therein. The body 21 also has a throttle shaft 26 rotatably supported therein, which is arranged to extend in the direction perpendicular to the mixture outlet region 25 to support a circular disc-type throttle valve 27 thereon. The throttle valve 27 is adapted to control the rate of a mixture of fuel and air fed to an engine. The throttle shaft 26 is formed at one end thereof with a projection outward projecting therefrom, which is provided with a spring means for rotating the throttle valve 27 in the closing direction, a means for adjusting the idling position of the throttle valve 27 and a means for rotating the throttle valve 27 in the opening direction in response to the operation of a driver or operator. These means are omitted from the drawings for clarity in the description because those are generally used in a conventional carburetor.

Figure 2:
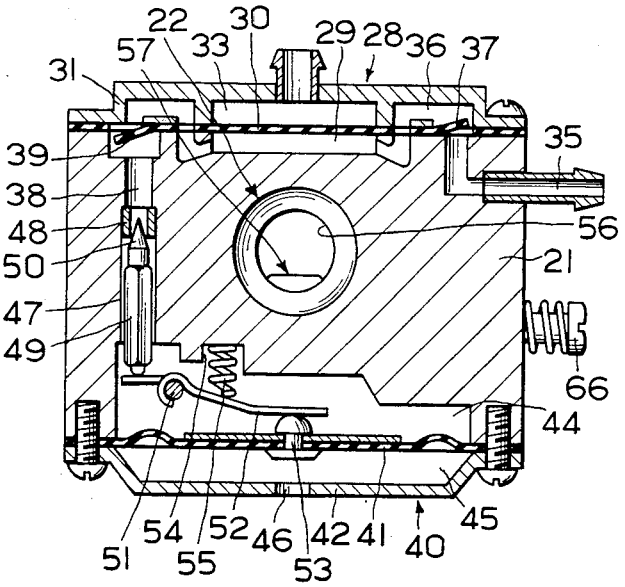
FIG. 2 is a vertical sectional view taken along line 2—2 of FIG. 1.

The carburetor body 21 is formed at one surface thereof parallel to the mixture passage 22 with a recess which is adapted to constitute a pumping chamber 29 for a fuel pump 28. Referring to FIGS. 1 and 2, the fuel pump 28 includes a diaphragm 30 adapted to carry out a pumping action, on which a cover member 31 is arranged. The diaphragm 30 and cover member 31 are fixedly mounted on the body 21 by means of screws 32 fixedly inserted in threaded holes formed at the body 21. The cover member 31 is formed on the inner surface thereof opposite to the diaphragm 30 with a recess which is adapted to define a pulse chamber 33 in cooperation with the diaphragm 30 therebetween. The cover member 31 is also provided at the substantially central portion thereof with a nipple or opening 34, through which the pulse chamber 33 is communicated with the interior of a crank case of a two-cycle engine; so that when the variation of pressure in the interior of the crank case of the two-cycle engine is transmitted to the pulse chamber 33, the diaphragm 30 constituting one of the surfaces of the pulse chamber 33 may be moved.

Fuel stored in a fuel tank (not shown) is fed to the pumping chamber 29 through an inlet passage 36 which is formed in a manner to initiate at a nipple or opening 35, extend through the body 21 and terminate at the cover member 31. Subsequently, the fuel is fed to an outlet passage 38 which is formed so as to initiate at the cover member 31 and extend through the body 21. When the diaphragm 30 is moved toward the pulse chamber 33 or cover member 31 due to the pressure variation or pulse in the pulse chamber 33, an inlet check valve 37 provided in the inlet passage 36 is opened to introduce fuel into the pumping chamber 29. At this time, an outlet check valve 39 provided in the outlet passage 38 is kept at a closed state. Then, when the diaphragm 30 is moved toward the pumping chamber 29, the inlet check valve 37 is closed and the outlet check valve 39 is opened to cause fuel in the pumping chamber 29 to flow toward the outlet passage 38. The diaphragm 30, as described above, forms a flexible wall which acts as one of the walls of the pumping chamber 29, so that the suction and discharge of fuel may be carried out due to the variation of pressure in the pulse chamber 33 provided separate from the pumping chamber 29 through the flexible wall or diaphragm 30.

The inlet check valve 37 and outlet check valve 39 each are of the cantilever type utilizing a cut formed at the diaphragm 30 which is constructed in such a manner as widely known in the art.

The carburetor or charge forming apparatus of the illustrated embodiment also includes a fuel pressure control mechanism generally designated by reference numeral 40, which is arranged opposite to the fuel pump 28 with the mixture passage 22 interposed therebetween. The fuel pressure control mechanism 40 includes a flexible diaphragm 41 mounted on the body 21 to cover a recess formed at the body 21 and a cover member 42 disposed so as to cover the diaphragm 41 and allow a space acting as a fuel pump to be defined between the recess and the diaphragm 41. A space 45 defined between the diaphragm 41 and the cover member 42 serves as an air chamber and one surface of the diaphragm 41 is communicated with ambient atmosphere through an opening 46 formed at the cover member 42.

In the illustrated embodiment, the outlet passage 38 is communicated with a bore 47 which is in turn communicated with the upper portion of the fuel chamber 44. The outlet passage 38 is provided at the end portion thereof connected to the bore 47 with a valve seat 48, which is adapted to be in cooperation with a cone-shaped portion 50 formed at the upper end of a valve body 49 to control the flow rate of fuel to be fed from the outlet passage 38 to the fuel chamber 44. The valve body 49 is formed to be polygonal in section and inserted into the bore 47, with a gap being defined between the bore 47 and the valve body through 49 which fuel is fed to the fuel chamber 44.

The fuel chamber 44 is provided therein with a lever 52 which is supported by a pin 51 mounted on the body 21. The lever 52 is adapted to be contacted at one end thereof with the head portion of a rivet 53 provided at the central portion of the diaphragm 41 and at the other end thereof with the lower end of the valve body 49. The lower recess of the body 21 is provided on the upper surface with a bore 54 and a coil spring 55 is arranged between the the bore 54 and the lever 52. The coil spring 55 serves to cause the cone-shaped portion 50 of the valve body 49 to contact with the valve seat 48 to interrupt the supply of fuel to the fuel chamber 44.

When the amount of fuel collected on the diaphragm 41 is decreased, the diaphragm 41 is upward moved to cause the lever 52 to be rotated in the counter-clockwise direction in FIG. 2, to thereby increase a gap between the valve seat 48 and the cone-shaped portion 50 of the valve body 49. This results in the flow rate of fuel fed from the outlet passage 38 of the fuel pump 28 to the fuel chamber 44 being increased. On the contrary, when the amount of fuel collected on the diaphragm 41 is increased, the diaphragm 41 is downward moved to cause the lever 52 to be rotated in the clockwise direction due to the force of the coil spring 55, to thereby reduce the gap between the valve seat 48 and the cone-shaped portion 50 of the valve body 49.

Figure 3:
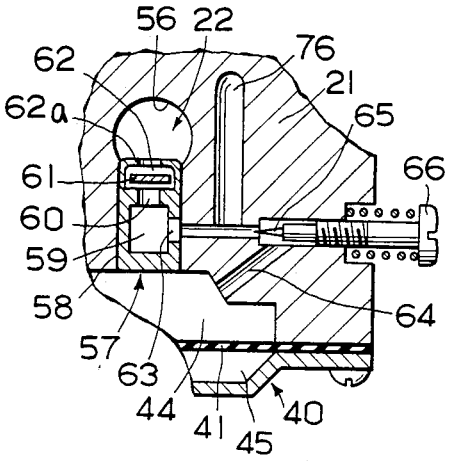
FIG. 3 is a vertical sectional view taken along line 3—3 of FIG. 1.
Figure 4:
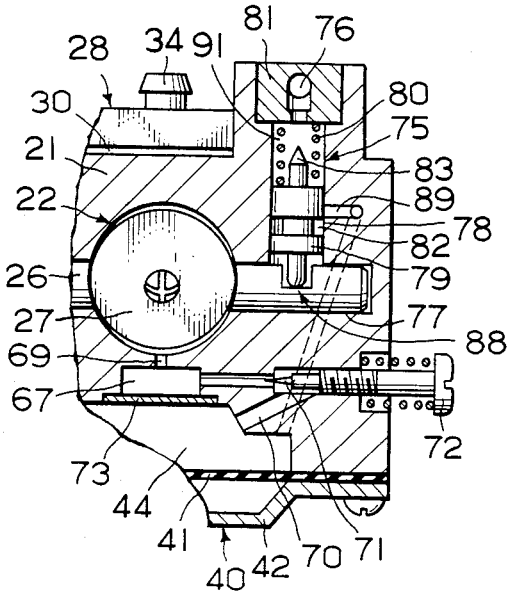
FIG. 4 is a vertical sectional view taken along line 4—4 of FIG. 1.

A means for feeding fuel stored in the fuel chamber 44 to the mixture passage 22 is shown in FIGS. 1, 3 and 4, particularly, in FIGS. 3 and 4.

More particularly, a supply means for main fuel is shown in FIGS. 1 and 3 wherein a main nozzle assembly 57 is arranged in a manner to face a choke band region 56 of the smallest diameter in the venturi 24 of the mixture passage 22. The main nozzle assembly 57 is fitted in a bore 58 formed at the body 21 and provided with a nozzle hole 60 for allowing a room 59 through which fuel oil is flowed to be opened therethrough toward the choke band region 56, a counter bore 62 in which a disc valve 61 positioned above the nozzle hole 60 is received, an edge 62*a* formed by inward bending the distal end of the upper portion of the assembly 57 defining the counter bore 62, and an opening 63 for feeding fuel therethrough to the room 59.

The carburetor body 21 is formed therein with a supply passage 64 for main fuel through which the fuel chamber 44 is communicated with the opening 63. Also, the body 21 is formed with a threaded hole in which an adjust screw is threadedly inserted which has a needle valve 65 provided at the distal end thereof to control fuel flowing through the supply passage 64.

When the throttle valve 27 is substantially opened at the idling or lower rotational speed of an engine, air is caused to flow through the choke band region 56 of the venturi 24 with a high velocity to generate high negative pressure at the counter bore 62, nozzle hole 60 and room 59. The high negative pressure results in fuel in the fuel chamber 44 being fed through the main fuel supply passage 64, opening 63, room 59 to the nozzle hole 60 and subsequently through gap between the disc valve 61 and the edge 62*a* to the mixture passage 22.

The carburetor of the illustrated embodiment as shown in FIGS 1 and 4, also includes a supply means for supplemental fuel flowed at a low velocity. More particularly, the body 21 is provided therein with a chamber 67, and a slow port 68 and an idle port 69 each communicated with the chamber 67. The ports 68 and 69 each are opened at the vicinity of the throttle valve 27 of the mixture outlet region 25.

Further, the body 21 is provided therein with a supplemental fuel supply passage 70 through which the fuel chamber 44 is communicated with the chamber 67. Also, the body 21 is formed therein a threaded hole in which an adjust screw 72 is threadedly inserted which has a needle valve 71 provided at the distal end thereof to control fuel flowing through the supply passage 70.

When an engine is at an idling state or driven at a low rotational speed, the throttle valve 27 substantially closes the mixture passage 22 to generate high negative pressure on the engine side from the throttle valve 27, so that fuel may be fed from the idle port 69 and/or slow port 68 to the mixture passage 22.

The chamber 67 is constituted by a recess formed in the fuel chamber 44 and closed by a cap 73.

The carbureter of the illustrated embodiment further includes an acceleration mechanism and an acceleration pump as illustrated in FIGS. 4 to 12.

The acceleration mechanism shown in FIGS. 4 to 7 includes an acceleration pump 75 and a passage 76 through which the main fuel supply pipe 64 is connected to the acceleration pump 75.

The acceleration pump 75 has a cylindrical chamber 78 perpendicularly connected to a bore 77 provided in the body 21 so as to support the throttle shaft 26 in the body 21 and a piston 79 and a coil spring 80 fittedly received in the cylindrical chamber 78. The cylindrical chamber 78 is provided in the body 21 and is closed at the end thereof opposite to the bore 77 by a plug 81. The piston 79 has an annular groove 82 formed at the middle portion thereof. Also, the piston 79 is provided at the distal end thereof with a cone-shaped valve member 83 and at the base end thereof with a piston rod 84.

The passage 76 is formed to extend from the position between the portion of the main fuel supply passage 64 at which the needle valve 65 is disposed and the opening 63 through the body 21 and plug 81 to the end surface of the cylindrical chamber 78, and opened at the central portion of the end surface of the cylindrical chamber 78.

Figure 5:
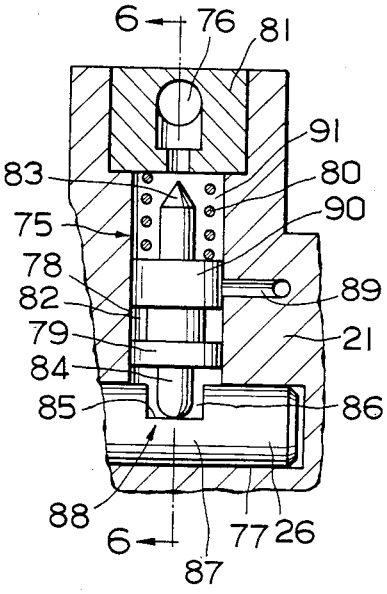
FIG. 5 is a fragmentary enlarged view showing an acceleration pump shown in FIG. 4.
Figure 6:
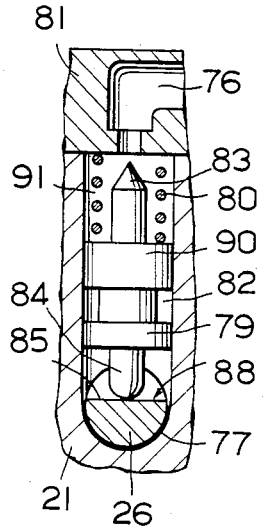
FIG. 6 is a sectional view taken along line 6—6 of FIG. 5.

The throttle shaft 26 is formed on one end surface thereof with a recess 86 which has a plain face 85 extending in the radial direction of the throttle shaft 26. The plain face 85 is adapted to constitute a cam in cooperation with the surface of the throttle shaft 26 continuous from the plain face 85. When the throttle valve 27 is at the closed position, the portion of the cam 88 constituted by the plain face 85 is substantially perpendicular to the longitudinal direction of the piston as shown in FIGS. 4, 5 and 6.

The coil spring 80 is arranged between the plug 81 and the piston 79 and acts to allow the base end of the piston rod 84 to constantly contact with the cam 88.

Reference numeral 89 designates a passage provided in the body 21 to supply fuel in the fuel chamber 44 therethrough to the cylindrical chamber 78. The passage 89 is communicated with the cylindrical chamber 78 at the portion thereof positioned above the annular groove 82 when the piston 79 is at the position shown in FIGS. 4, 5 and 6.

When the throttle shaft 26 is rotated in the direction of opening the throttle valve 27, the portion of the cam 88 constituted by the plain face 85 causes the piston 79 to be moved toward the plug 81. The space of the cylindrical chamber 78 in which the coil spring 80 is received constitutes a pumping chamber 91, and fuel in the pumping chamber 91 is forced out from the passage 76 to the supply passage 64 by the piston 79. This results in fuel for acceleration being fed from the main nozzle assembly 57 to the mixture passage 22.

Figure 7:
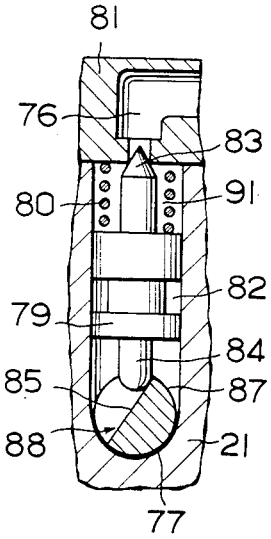
FIG. 7 is a sectional view similar to FIG. 6 showing an acceleration pump wherein a throttle valve is fully opened.

The position of the piston 79 obtained when the throttle valve 27 is opened fully or to a maximum degree is shown in FIG. 7. This causes the passage 89 to be communicated with the annular groove 82, so that fuel may be charged in the annular groove 82. Then, the fuel charged in the annular groove 82 forms a membrane or film at a gap between the cylindrical chamber 78 and the piston 79 due to the surface tension. The film ensures the lubrication of the piston and the airtightness of the gap in cooperation with fuel received in the annular groove 82.

The cone-shaped valve member 83, as shown in FIG. 7, is adapted to close the passage 76 when the throttle valve 27 is opened to a maximum degree. This causes high negative pressure to be generated in the nozzle hole 60 opened with respect to the choke band region 56 of the venturi 24 when an engine generates high output. The so-formed high negative pressure allows the valve member 83 to effectively prevent air in the mixture outlet region from leaking from a gap between the throttle shaft 26 and the wall of the bore 77 for supporting the throttle shaft 26 therein through a gap between the wall of the cylindrical chamber 78 and the piston 79 to the passage 76 and supply passage 64. This effectively eliminates such a defect as encountered with the prior art that the mixing of air in fuel fed from the supply passage 64 to the mixture passage 22 at the high output of an engine causes the deficiency of fuel fed to an engine to incur a decrease in output of the engine.

When the throttle valve 27 is closed, the piston 79 is moved away from the plug 81 by the force of the coil spring 80 while keeping the contact between the piston rod 84 and the cam 88. At this time, fuel is introduced from the supply passage 64 through the passage 76 to the pumping chamber 91.

Figure 8:
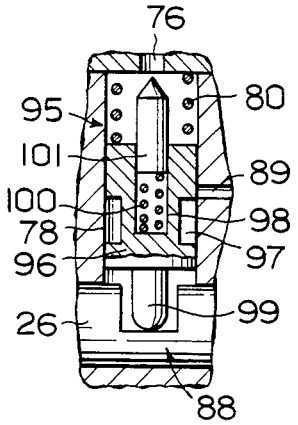
FIG. 8 is a sectional view similar to FIG. 6 showing an acceleration pump constructed in a manner different from that shown in FIGS. 6 and 7.

A preferred modification of the acceleration pump 75 shown in FIGS. 4 to 7 is shown in FIG. 8.

An acceleration pump generally designated by 95 in FIG. 8 includes a cylindrical chamber 78, and a piston 96 and a coil spring 80 which are fittedly received in the cylindrical chamber 78. The piston 96 is formed at the intermediate portion thereof with an annular groove 97 and at the distal end thereof with a bore 98. Also, the piston 96 has a piston rod 99 provided at the base end thereof. In the bore 98 are fitted a cushioning means 100 constituted by a coil spring and a valve body 101 having a cone-shape distal end in turn. The valve body 101 is received in the bore 98 in a manner such that the cone-shaped end is projected from the bore 98. The remaining portions of the acceleration pump 95 shown in FIG. 8 are constructed in the substantially same manner as that shown in FIGS. 4 to 7.

The manner of operation of the acceleration pump 95 shown in FIG. 8 will be hereinafter described.

When the cam 88 of the throttle shaft 26 actuates the piston 96, fuel in a pumping chamber 91 is fed through the passage 76 to the main nozzle assembly. When the throttle valve is nearly fully opened, the valve body 101 closes the passage 76; and then, when the throttle valve is fully opened, the cushioning means 100 is compressed to cause the valve body 101 to be forcedly pressed against the edge of the passage 76 due to the compression force of the cushioning 100. Further, when the throttle valve is closed, the piston 96 is moved away from the plug 81 due to the force of the coil spring 80. This results in fuel in the fuel chamber being fed through the passage 89 to the annular groove 97.

Figure 9:
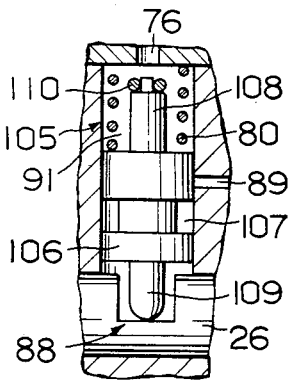
FIG. 9 is a sectional view similar to FIG. 6 showing another modification of an acceleration pump adapted to be used in the present invention.

FIG. 9 shows another preferred modification of the acceleration pump used in the present invention.

An acceleration pump generally indicated by reference numeral 105 includes a cylindrical chamber 78, and a piston 106 and a coil spring 80 which are fittedly received in the cylindrical chamber 78. The piston 106 is formed at the intermediate portion thereof with an annular groove 107 which is adapted to receive therein fuel fed from the fuel chamber through the passage 89 thereto. The piston 106 is also provided at the distal end thereof with a piston portion 108 of a small diameter and at the base end thereof with a piston rod 109. The piston portion 108 preferably has a sealing member 110 comprising an O-ring fitted thereon.

In the acceleration pump 105 of FIG. 9 constructed as described above, when the cam 88 of the throttle shaft 26 actuates the piston 106, fuel in a pumping chamber 91 is fed through the passage 76 to the main nozzle assembly. When the throttle valve is nearly fully opened, the sealing member 110 is abutted against or contacted with the edge of the passage 76 to close the passage 76. Further, the throttle valve is fully opened, the sealing member 100 is compressed and forcedly pressed against the edge of the passage 76. When the throttle valve is closed, the piston 106 is moved away from the plug 81 due to the elastic force of the coil spring 80.

As can be seen from the foregoing, the acceleration pumps 75, 95 and 105 described above each are adapted to carry out the introduction and discharge of fuel through the passage 76 connected to the main fuel supply passage and allow supplemental fuel for the acceleration of an engine to be supplied from the nozzle hole 60 for main fuel to the mixture passage 22. Thus, the incorporation of each of the acceleration pumps into the carburetor is capable of effectively eliminating the provision of an acceleration nozzle only acting to feed fuel for acceleration to the mixture passage 22.

Figure 10:
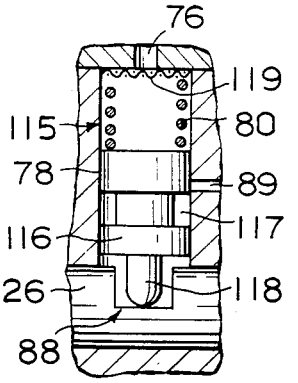
FIG. 10 is a sectional view similar to FIG. 6 showing still a further modification of an acceleration pump.

FIG. 10 illustrates a further modification of the acceleration pump, which is constructed to function in a manner different from the above-described acceleration pumps 75, 95 and 105.

An acceleration pump generally designated by reference numeral 115 in FIG. 10 includes a cylindrical chamber 78, and a piston 116 and a coil spring 80 which are fittedly received in the cylindrical chamber 78. The piston 116 is formed at the intermediate portion thereof with an annular groove 117 which is adapted to receive therein fuel fed from the fuel chamber through the passage 89 thereto. The piston 116 also has a piston rod 118 provided at the base end thereof. The acceleration pump further includes a screen 119 which is arranged in the cylindrical chamber 78 forcedly pressed against one end wall of the cylindrical chamber 78 due to the elastic force of the coil spring 80. The screen 119 is preferably made of a wire mesh. The screen 119 is arranged to cover the opened connection end of the acceleration fuel passage 76 with respect to the cylindrical chamber 78.

In the acceleration pump 105 constructed in such a manner as described above, when the cam 88 of the throttle shaft 26 actuates the piston 116, fuel in the pumping chamber 91 is discharged through the screen 119 to the passage 76 and then fed therefrom to the main nozzle assembly.

The screen 119 has micro-interstices formed therein which prevent air bubbles contained in fuel from upward passing therethrough due to buoyancy but permit the forced passage of the air bubbles therethrough by the actuation of the piston 116. Thus, it will be noted that when air is collected in the cylindrical chamber 78, the screen 119 effectively prevents the collected air from escaping from the chamber 78 therethrough to the passage 76 due to buoyancy and reaching the main nozzle assembly; whereas, when the piston 116 is actuated, the collected air is divided into a plurality of fine air bubbles by the screen 119 and the so-formed fine air bubbles are fed through the screen 119 to the mixture passage in a manner mixed with fuel. This effectively prevents the delivery of only air to the mixture passage when the piston 116 is actuated.

Figure 11:
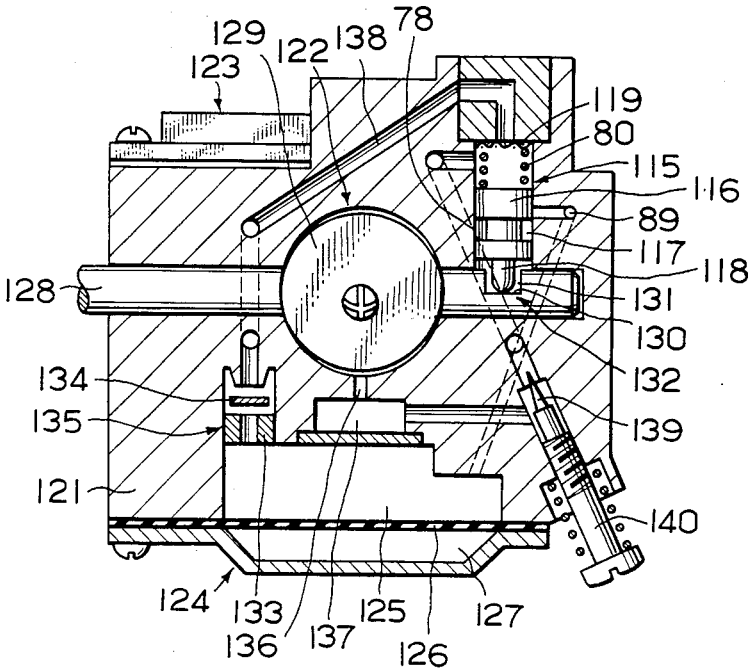
FIG. 11 is a sectional view similar to FIG. 4 showing a carburetor according to the present invention having an acceleration mechanism of another construction incorporated therein.
Figure 12:
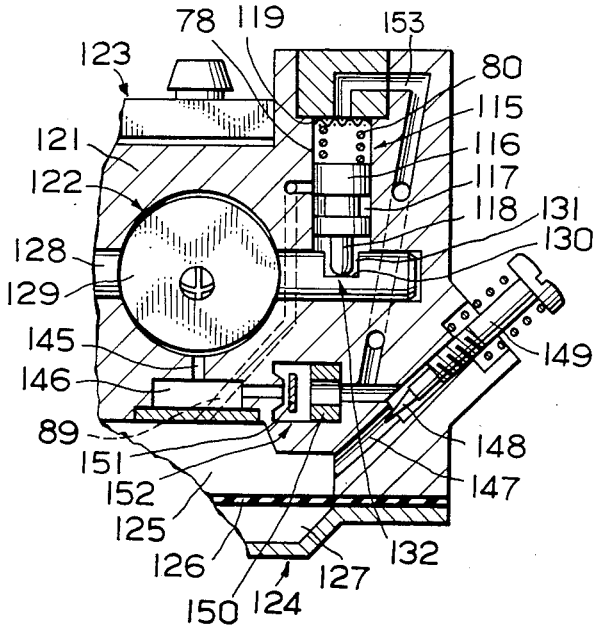
FIG. 12 is a sectional view similar to FIG. 4 showing a carburetor according to the present invention having an acceleration mechanism of a further construction incorporated therein.

FIGS. 11 and 12 each illustrate a carburetor of the present invention in which another preferred modification of the acceleration mechanism constructed in a manner different from that described above is incorporated.

In a carburetor shown in each of FIGS. 11 and 12, a body 121 having a mixture passage 122 formed therein is provided on one surface thereof with a fuel pump 123 and on the opposite surface thereof with a fuel pressure control mechanism 124. The fuel pressure control mechanism 124 is constructed in a manner similar to the fuel pressure control mechanism 40 described above and includes a fuel chamber 125 for receiving therein fuel fed thereto by the fuel pump 123, a flexible diaphragm 126 defining one of the walls of the fuel chamber 125 and an air chamber 127.

Reference numeral 128 designates a throttle shaft rotatably supported in the body 121 across the mixture passage 122, which is adapted to support a throttle valve 129 thereon. The throttle shaft 128 is formed at one end thereof with a recess 131 having a plain face extending in the radial direction thereof, the recess 131 forming a cam 132 in cooperation with the outer surface of the throttle shaft 128 continuous from the recess 131.

The carburetor shown in each of FIGS. 11 and 12 also includes an acceleration mechanism provided in the body 121 which comprises an acceleration pump and a supply means for feeding fuel when the rotational speed of an engine is low (hereinafter referred to as "supplemental fuel supply means").

More particularly, the acceleration pump generally designated by reference numeral 115 is constructed in the substantially same manner as the acceleration pump shown in FIG. 10 and includes a piston 116 provided with an annular groove 117 and a piston rod 118, a cylindrical chamber 78, a coil spring 80 and a screen 119. The coil spring 80 serves to forcedly press the screen 119 and the piston rod 118 against the end wall of the cylindrical chamber 78 and the cam 132, respectively.

The low-speed fuel supply means in the carburetor shown in FIG. 11 includes a check valve 135 comprising a valve seat 133 fitted in a recess formed at the fuel chamber 125 and a disc valve member 134 received in the recess, a chamber 137 communicated with a slow port and an idle port 136, a supply passage 138 for communicating the check valve 135 and the chamber 137 with each other therethrough, and an adjust screw 140 having a needle valve 139 for controlling fuel flowing through the passage 138. The adjust screw 140 is threadedly inserted in a threaded hole formed in the body 121.

The cylindrical chamber 78 of the acceleration pump 115 is provided on the way along the supply passage 138, so that fuel in the fuel pump 125 may be fed through the opened upper wall of the cylindrical chamber 78 and the screen 119 to the chamber 78 and then through the opened side wall of the cylindrical chamber 78 to the chamber 137.

In the carburetor shown in FIG. 11, when the piston 116 is actuated by the cam 132, to thereby close the check valve 135, fuel in the chamber 78 is fed to the chamber 137 and then from the slow port and idle port 136 to the mixture passage 122 for acceleration. At this time, fuel pressurized by the acceleration pump 115 is caused to flow around the needle valve 139 for controlling supplemental fuel with a high velocity to wash the needle valve 139. Thus, it will be noted that even when fine solid contaminant contained in fuel is adhered to the needle valve 139, it is effectively removed from the needle valve by the cleaning action of fuel to precisely control supplemental fuel. The pumping chamber 91 of the cylindrical chamber 78 is increased in volume when the throttle valve is closed. At this time, the portion of the supply passage 138 between the pumping chamber 91 and the chamber 137 is constricted by the needle valve 139, so that air in the mixture passage 122 may not be substantially sucked in the pumping chamber 91. It should be noted that in the acceleration mechanism shown in FIG. 11, there is provided no passage exclusively used for carrying out the introduction and/or discharge of fuel for acceleration with respect to the cylindrical chamber 78.

The supplemental fuel supply means in the carburetor shown in FIG. 12 includes a chamber 146 communicated with a slow port and an idle port 145, a supply passage 147 for communicating the fuel pump 125 and the chamber 146 with each other therethrough, an adjust screw 149 having a needle valve 148 for controlling fuel flowing through the supply passage 147, and a check valve 152 comprising a valve seat 150 and a disc valve member 151 arranged in the supply passage 147. The adjust screw 149 is threadedly inserted in a threaded hole formed in the body 121.

Also, in the carburetor shown in FIG. 12, a passage 153 communicated with the cylindrical chamber 78 at the end wall thereof having the screen 119 mounted thereon is connected to the portion of the supply passage 147 between the needle valve 148 and the check valve 152.

In the carburetor shown in FIG. 12 constructed above, when the piston 116 is actuated by the cam 132, fuel in the pumping chamber 91 is delivered through the screen 119 and passage 153 to the supply passage 147 to open the check valve 152. Then, the fuel is fed through the chamber 146, slow port and idle port 145 to the mixture passage 122 for use for acceleration. On the slow port and idle port 145 acts negative pressure which is generated due to air flowing toward an engine and the needle valve 148 constricts the supply passage 147, so that fuel for acceleration is prevented from flowing toward the fuel chamber 125.

The pumping chamber 91 is increased in volume when the throttle valve 129 is closed. At this time, the check valve 152 is closed which is positioned between the connection of the supply passage 147 with the passage 153 and the chamber 146, thus, air in the mixing passage 122 is not sucked into the pumping chamber 91.

The cylindrical chamber 78 of the acceleration pump 115 shown in each of FIGS. 11 and 12 is communicated with the passage 89 for introducing fuel for lubrication and sealing from the fuel chamber 125 thereto. Also, the acceleration pump 115 is connected to the supply passages 138 and 147 for supplemental fuel, so that fuel for acceleration of an engine may be fed from the slow port and idle port to the mixture passage 122. Thus, in the carbureter shown in each of FIGS. 11 and 12, it is never required to provide an acceleration nozzle which is exclusively used to feed fuel for acceleration to the mixture passage 122 and fuel for acceleration can be fed to the portion of the mixture passage 122 adjacent to an engine.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A charge forming apparatus comprising:

a body which is formed therein with a mixture passage having a throttle valve arranged therein;

a fuel pressure control mechanism arranged on said body, said fuel pressure control mechanism comprising a fuel chamber from which controlled fuel is fed to said mixture passage and a flexible diaphragm defining one of the walls of said fuel chamber;

cam means formed at a throttle shaft supporting said throttle valve thereon;

an acceleration mechanism including an acceleration pump which comprises a cylindrical chamber formed in said body, a piston received in said cylindrical chamber and formed at the intermediate portion thereof with an annular recess, and spring means for contacting said piston with said cam means; and a fuel passage for lubrication and airtightness which extends from said fuel chamber and is communicated with said cylindrical chamber at the portion of the side wall of said cylindrical chamber facing the side surface of said piston.

2. The apparatus of claim 1, additionally comprising a main supply passage through which the fuel is fed from said fuel chamber to a main nozzle communicating with said mixture passage, and a supplemental supply passage communicating said main supply passage and said cylindrical chamber.

3. A charge forming apparatus comprising:

a body which is formed therein with a mixture passage having a throttle valve arranged therein;

a fuel pressure control mechanism arranged on said body, said fuel pressure control mechanism comprising a fuel chamber from which controlled fuel is fed to said mixture passage and a flexible diaphragm defining one of the walls of said fuel chamber;

cam means formed at a throttle shaft supporting said throttle valve thereon;

an acceleration mechanism comprising an acceleration pump and a passage for supplemental fuel, said acceleration pump comprising a cylindrical chamber formed in said body, a piston received in said cylindrical chamber and spring means for contacting said piston with said cam means, said passage for supplemental fuel being communicated with said cylindrical chamber; and a screen arranged to cover the opened connection of said passage with said cylindrical chamber.

4. The apparatus of claim 3, wherein said screen is forcedly pressed against an upper end of said cylindrical chamber.

5. A charge forming apparatus comprising a body which is formed therein with a mixture passage having a throttle valve arranged therein;

a fuel pressure control mechanism arranged on said body, said fuel pressure control mechanism comprising a fuel chamber from which controlled fuel is fed to said mixture passage and a flexible diaphragm defining one of the walls of said fuel chamber;

cam means formed at a throttle shaft supporting said throttle valve thereon;

an acceleration mechanism comprising an acceleration pump and a passage for supplemental fuel, said acceleration pump comprising a cylndrical chamber formed in said body, a piston received in said cylindrical chamber and spring means for contacting said piston with said cam means, said passage for supplemental fuel being communicated with said cylindrical chamber; and a screen arranged to cover the opened connection of said passage with said cylindrical chamber, wherein said screen is forcedly pressed against the end wall of said cylindrical chamber by said spring means for contacting said piston with said cam means.

6. A charge forming apparatus comprising:

a body which is formed therein with a mixture passage having a throttle valve arranged therein;

a first supply passage through which fuel is fed to a main nozzle communicated with said mixture passage;

a second supply passage through which fuel is fed to a slow port and an idle port;

a fuel pressure control mechanism arranged on said body, said pressure control mechanism comprising a fuel chamber from which controlled fuel is fed to said first and second supply passages and a flexible diaphragm defining one of the walls of said fuel chamber;

cam means formed at a throttle shaft supporting said throttle valve thereon; and an acceleration pump comprising a cylindrical chamber formed in said body, a piston received in said cylindrical chamber and spring means for contacting said piston with said cam means, said cylindrical chamber constituting a part of said second supply passage.

7. A charge forming apparatus comprising:

a body which is formed therein with a mixture passage having a throttle valve arranged therein;

a fuel pressure control mechanism arranged on said body, said fuel pressure control mechanism comprising a fuel chamber from which controlled fuel is fed to said mixture passage and a flexible diaphragm defining one of the walls of said fuel chamber;

cam means formed at a throttle shaft supporting said throttle valve thereon;

an acceleration pump comprising a cylindrical chamber formed in said body, a piston received in said cylindrical chamber and spring means for contacting said piston with said cam means; and a fuel supply passage of which a part is formed by said cylindrical chamber, said fuel supply passage having a check valve arranged at the portion thereof between said fuel chamber and said cylindrical chamber so as to be closed toward said fuel chamber and a needle valve arranged at the portion thereof between said cylindrical chamber and slow and idle ports communicated with said mixture passage so as to control fuel.

* * * * *